United States Patent [19]

Janci

[11] 3,958,301

[45] May 25, 1976

[54] GRAVITY-ACTUATOR CLOSURE HARDWARE

[76] Inventor: John Janci, 1125 N. Karlov, Chicago, Ill. 60651

[22] Filed: Nov. 15, 1974

[21] Appl. No.: 524,110

[52] U.S. Cl. ..... 16/152

[51] Int. Cl.[2] ..... E05F 1/06

[58] Field of Search ..... 16/152–156, 16/186, 171, 128 R, 136

[56] References Cited

UNITED STATES PATENTS

| | | | |
|---|---|---|---|
| 1,481,181 | 1/1924 | Brooks | 16/156 |
| 3,015,839 | 1/1962 | Eskridge et al. | 16/136 |
| 3,036,331 | 5/1962 | Skolnik | 16/136 X |
| 3,107,390 | 10/1963 | Shelton | 16/152 |
| 3,832,754 | 9/1974 | Combs et al. | 16/152 |
| 3,832,755 | 9/1974 | Combs et al. | 16/156 |

*Primary Examiner*—G. V. Larkin

[57] ABSTRACT

Gravity-actuated self-closing hardware adapted to be attached to a closure, such as a door, for mounting swingably the door to a door frame to enable the door to swing between an open position out of the plane of the door frame and a closed position disposed within the plane of the door frame, includes an upper universal mounting device adapted to mount the top edge of the door at one of the top corner portions thereof to the door frame to support swingably and universally the door from the frame about a point disposed within the plane of the door frame so that the door disposed normally at rest in the closed position can swing out of the plane of the door frame and the lower portion of the door can tilt upwardly, and a lower universal mounting device adapted to mount the side edge of the door near the bottom edge thereof below the upper device to the adjacent portion of the door frame to cause the lower portion of the door to swing about a point outside of the plane of the door frame and to cause the lower portion of the door to tilt upwardly as the door swings open. After the door is pulled to its open position, it may be released to permit the door to fall under the force of gravity and to swing about the lower and upper devices from its open position to its closed position without the need for separate door closing mechanisms.

6 Claims, 6 Drawing Figures

GRAVITY-ACTUATOR CLOSURE HARDWARE

The present invention relates in general to a gravity-actuated closure hardware, and it more particularly relates to such a hardware which may be used in connection with a closure, such as a door, to enable it to swing from an open position out of the plane of the door frame and a closed position disposed within the plane of the door frame under the force of gravity.

Self-closing door hardware has been employed in the past to facilitate the closing of a door under the force of gravity for the purpose of eliminating other types of door closing mechanisms. For example, reference may be made to U.S. Pat. Nos. 557,473 and 2,904,819. In the U.S. Pat. No. 557,473, there is disclosed a door hinge for enabling a door to be self-closing by including a lug which rides up on an incline as the door swings open. In the U.S. Pat. No. 2,904,819, there is disclosed a door closing hardware which is also gravity-actuated, by including a boss which causes one of the high sides of a cam to move into engagement with a roller for the purpose of lifting the door as it is rotated about its vertical axis, whereby when the door is released, the door falls under the force of gravity and swings toward its closed position as the boss rotates to bring the roller toward the lowermost point on the cam. However, such inclines and cams have not been entirely satisfactory for some applications in that they are costly to manufacture when precision operation is desired. Therefore, it would be highly desirable to have gravity-actuated closure hardware, which serves to enable a closure panel to swing from an open position to a closed position under the force of gravity without the need for conventional hinges or a closing device, and which swingably mounts the closure panel or door to a support frame or door frame. Additionally, such closure hardware should be relatively inexpensively manufacturable and yet be reliable in operation.

Therefore, the principal object of the present invention is to provide a new and improved gravity-actuated closure hardware which swingably mounts a closure panel on a support frame without the need for conventional hinges or a closing mechanism, and which operates efficiently and is relatively inexpensive to manufacture.

Briefly, the above and further objects are realized in accordance with the present invention by providing gravity-actuated closure hardware including an upper universal mounting device adapted to mount the top edge of a closure, such as a door, at an upper corner portion thereof to the frame to support swingably and universally the closure from the frame about a point disposed within the plane of the door frame so that the closure disposed normally at rest in a vertical disposition in the plane of the opening defined by the frame can swing out of the plane of the opening and the lower portion of the closure can tilt upwardly relative to the upper portion thereof. A lower universally mounted device is adapted to mount the side edge of the closure near the bottom edge thereof below the upper universal device to the adjacent portion of the frame to cause the lower portion of the door to swing about a point outside of the plane of the door frame and to cause the lower portion of the door to tilt upwardly as the door swings open. After the closure is pulled to its open position, it may be released to permit the closure to fall under the force of gravity from its opened position to its closed position without the need for separate closing mechanism.

The above, and still further highly important objects and advantages of the invention will become apparent from the following detailed specification, appended claims, and attached drawings, wherein:

Figure 1:
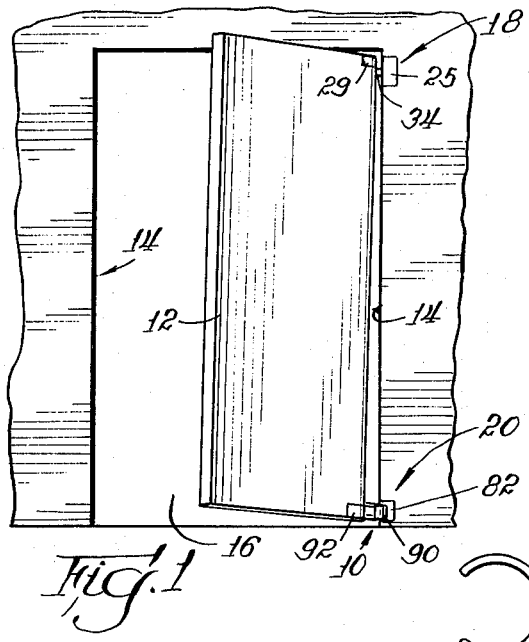
FIG. 1 is a front elevational view of a door swingably mounted on a door frame by means of gravity-actuated hardware which is constructed in accordance with the present invention, the door being illustrated in a partially open position.
Figure 4:
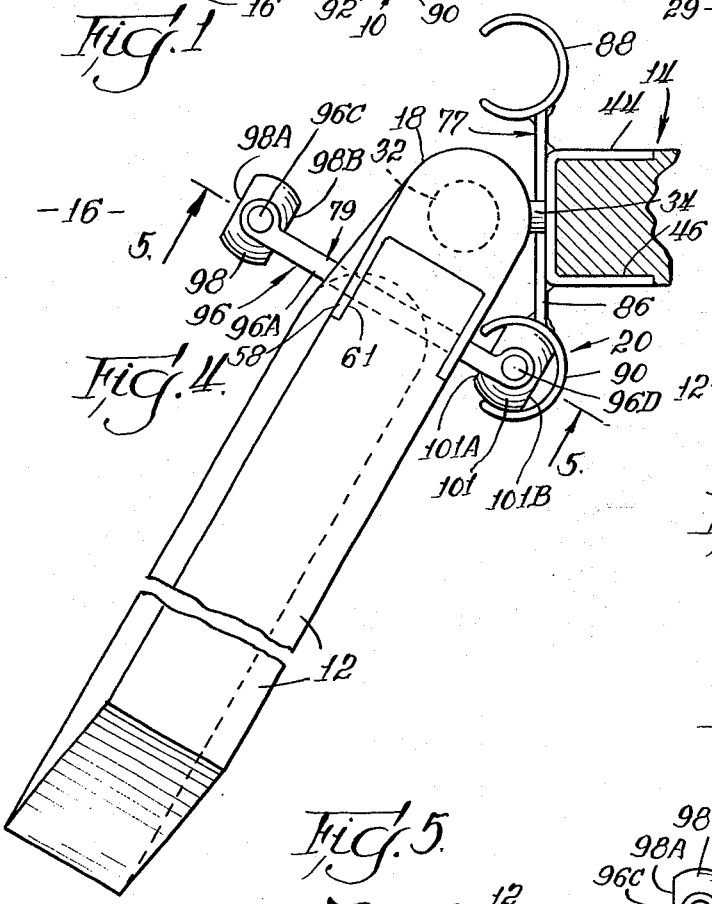
FIG. 4 is an enlarged horizontal cross-sectional fragmentary plan view of the hardware of FIG. 1, the door being illustrated in a partially open position.

Referring now to the drawings, and more particularly to FIG. 1 thereof, there is shown gravity-actuated self-closing hardware generally indicated at 10 for swingably mounting a closure, such as the door 12, to a support structure, such as the door frame 14 defining a door opening 16, the hardware 10 being constructed in accordance with the principles of the present invention. While the hardware 10 is shown and described herein in connection with a door and a door frame, it is to be understood that the hardware of the present invention may also be used in connection with other closures, such as cabinet doors or any other closure panels swingably connected to a support structure defining an opening. The hardware 10 generally comprises an upper universal mounting device 18 adapted to mount the top edge of the door 12 at a corner portion thereof to the door frame 14 to support swingably the door 12 from the frame 14, and a lower universal mounting device 20 adapted to attach the side edge of the door at the lower corner portion thereof to the adjacent portion of the door frame 14. In use, when the door 12 is pulled from its closed position within the opening 16 of the door frame 14, as shown in FIG. 4 the door 12 swings about the upper mounting device 18 to an open position out of the plane of the opening 16 defined by the door frame 14 and the lower portion of the door tilts slightly upwardly about the device 18 as well as the lower device 20 as hereinafter described in greater detail. When the door 12 is released by the user, the door 12 falls under the force of gravity and swings about the lower device 20 and the upper device 18 until the door 12 is disposed in its closed position in the plane of the opening 16. In the closed position, the device 20 again latches the bottom portion of the door 12 to the door frame 14 and limits further movement of the door 12. As hereinafter described in greater detail, the door 12 swings in both directions in a "double swing" manner and is gravity-actuated and self-closing in both directions.

Figure 2:
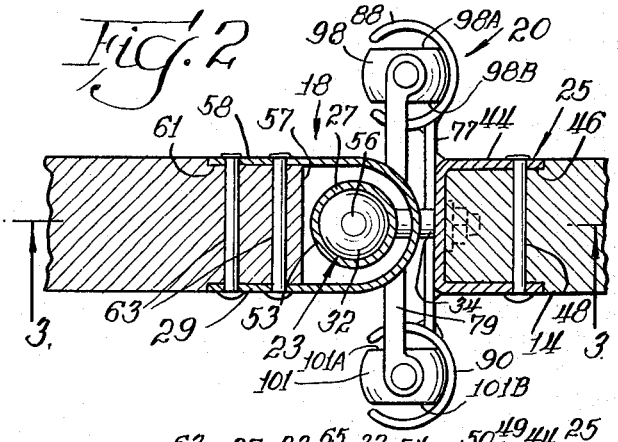
FIG. 2 is an enlarged vertical cross-sectional fragmentary plan view of the upper mounting device of the hardware of FIG. 1 and the upper universal mounting device of the present invention, illustrating the door in its closed position and the adjacent portion of the door frame.
Figure 3:
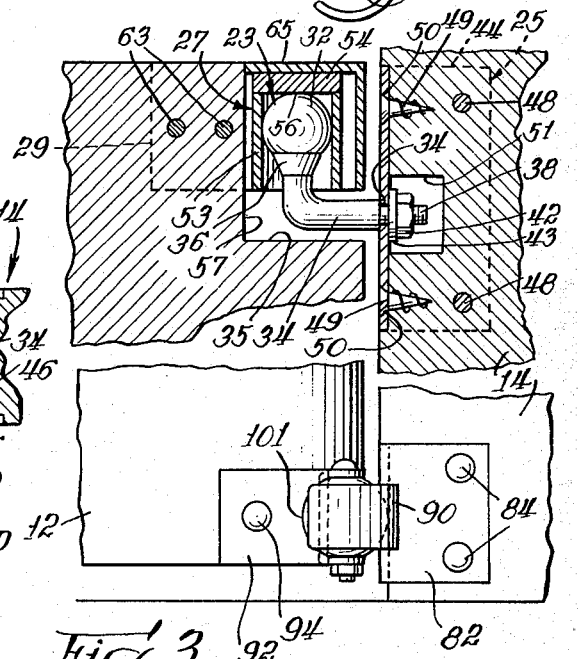
FIG. 3 is a cross-sectional view of the mounting device of FIG. 2 taken substantially along the line 3—3 thereof.

Considering now the upper mounting device 18 in greater detail with reference to FIGS. 2 and 3 of the drawings, the mounting device 18 generally includes a ball member 23 fixed to and extending from a U-shaped bracket 25 fixed to the door frame 14 for fitting into a socket 27 secured to the top edge portion of the door 12 by means of a bracket 29. The ball member 23 includes a truncated sphere 32 supported by an L-shaped rod 34 disposed in an opening or notch 35 in the top edge of the door 12, and an inverted truncated cone 36 integrally connects the sphere 32 and the rod 34 in a unitary manner. A threaded end portion 38 of the rod 34 extends through an aligned hole 40 in the bracket 25 and is secured in place by a nut 42 threaded onto the end portion 38 with a washer 43 interposed between the nut 42 and the bracket 25. The ball member 23 is composed of a suitable rigid material, such as metal, and is disposed such that the sphere 32 is positioned in an upright manner to engage the socket 27 to enable the socket and thus the door 12 to move in an universal manner about a point in a plane of the door opening 16.

The bracket 25 includes a U-shaped channel member 44 fitted into a complementary-shaped groove 46 (FIG. 2). A pair of rivets 48 or other suitable fastening devices fix the channel member 44 in place on the vertical portion of the door frame 14. A pair of wood screws 49 extend through aligned countersunk holes 50 in the channel member 44 to further facilitate the attachment of the channel member 44 to the door frame 14. An opening 51 in the vertical portion of the door frame 14 receives the end portion 38, the nut 42 and the washer 43.

The socket 27 includes a cylindrical vertically-disposed tube 53 surrounding the sphere 32 and truncted cone 36, and a plate 54 is fixed over the end of the tube 53 to serve as a bearing surface for a flat 56 on the top of the sphere 32. An opening 57 in the top edge of the door 12 serves to receive the socket 27. Thus, the sphere 32 is adapted to support the upper portion of the door 12 which may swivel in a universal manner thereabout and when the door 12 is pulled from its closed position in the plane of the door frame opening 16 to an open position as shown in FIG. 4 out of the plane of the door frame opening 16, the lower portion of the door 12 tilts upwardly and the socket 27 rocks about the sphere 32. The lower portion of the tube or sleeve 53 can rock due to the truncated cone 36 to enable the door 12 to tilt or rock upwardly as it swings to its open position.

The bracket 29 includes a U-shaped channel member 58 positioned in a complementary-shaped groove 61 (FIG. 2) in a somewhat similar manner as the bracket 25. A pair of rivets 63 or other suitable fastening devices are employed to secure the channel member 58 to the door 12. A top plate 65 is fixed by any suitable means, such as welding (not shown), to the upper portion of the channel member 58, the top plate 65 supporting the end plate 54 and thus the tube 53. The entire ball member 23, bracket 25, socket 27 and bracket 29 are composed of a suitable rigid material, such as metal. However, it is to be understood that other materials, such as plastic, may also be employed.

In order to enable the door 12 to pivot about the axis of the sphere 32, the side edge of the door 12 and the chanel member 58 are rounded as best seen in FIG. 2 to provide the necessary clearance as the door 12 moves to its open position as illustrated in FIG. 4.

Figure 5:
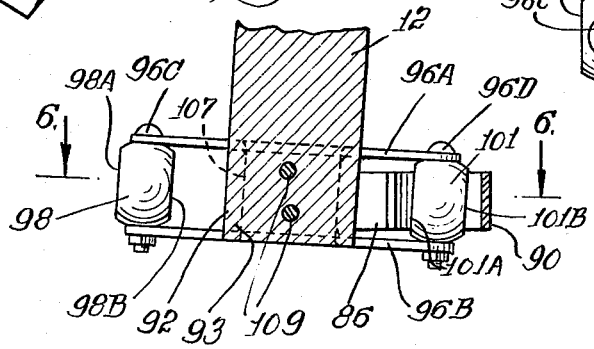
FIG. 5 is a cross-sectional view of the lower mounting device of FIG. 4 taken substantially along the line 5—5 thereof.
Figure 6:
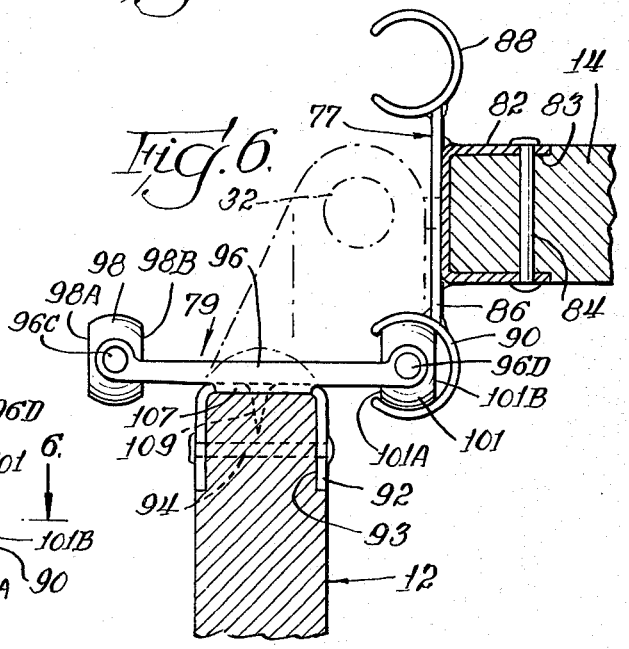
FIG. 6 is a cross-sectional view of the lower mounting device of FIG. 5 taken substantially along the line 6—6 thereof but for illustration purposes the door is shown in its fully open position.

Considering now the lower mounting device 20 in greater detail with reference to FIGS. 4, 5 and 6 of the drawings, the device 20 generally comprises a double socket 77 attached to the vertical portion of the door frame 14 near the floor, and a double arm 79 attached to the side edge of the door near the bottom thereof for engaging the double socket 77. The double socket 77 includes a channel member 82 which fits into a complementary-shaped groove 83 in the door frame 14, the channel-shaped member 82 being held in place by rivets 84 in a similar manner as the bracket 25 of the upper mounting device 18. An arm or bar 86 having sockets 88 and 90 at the opposite ends thereof is fixed to the channel member 82 with the sockets 88 and 90 positioned on opposite sides of and spaced from the plane of the door opening 16. The double arm 79 includes a channel member 92 which is disposed in a complementary-shaped groove or opening 93 in the bottom portion of the door 12 in a similar manner as the bracket 58 of the upper mounting device 18. A rivet 94, or similar fastening devices, is used to secure the channel-shaped member 92 in place in a similar manner as the rivets 63 for the bracket 58. An arm or bar 96 having fixed spheres or balls 98 and 101 at opposite ends thereof for engaging and being clamped in place by the C-shaped respective sockets 88 and 90. A pair of diametrically-opposed flats 98A and 98B on the sphere 98 and the flats 101A and 101B on the sphere 100 enable the sphere to be pulled out of engagement with its socket to enable the door 12 to swing into its open position as indicated in FIG. 4. In this regard, the flats on the spheres face one another in a direction transverse to the door 12 so that when the two spheres are disposed in engagement with their sockets 88 and 90, the flats on each one of the spheres cause the effective diameter of the spheres to be shortened so that the spheres can be pulled out of engagement with the sockets. Thus, when the door 12 is pulled into its open position, the sphere on the opposite side of the door slips out of engagement with its socket and swings into a position as indicated in FIG. 4 about the axis of the other sphere, such as the sphere 101 of FIG. 4, as well as the axis of the sphere 32 of the upper mounting device.

The arm or bar 96 includes a pair of horizontal spaced-apart elongated plates 96A and 96B joined together by a vertical plate 107 fixed to the lower side edge of the door 12 by screws 109. A pair of nuts and bolts 96C and 96D fix the spheres 98 and 101 in place at opposite ends of the plates. The spheres 98 and 101 are composed of metal, but they may be composed of metal, plastic or other suitable material. The arm 96 and the socket 77 serve as guides to cause the door 12 to tilt outwardly and upwardly when the door swings open, and the upper mounting device 18 provides the sole support for the door 12 and carries the weight of the door on the sphere 32.

When a person pulls the door into an open position as indicated in FIG. 4, the sphere 98 is pulled out of engagement with its socket 88, and the door 12 pivots about the axis of the upper sphere 32 and the axis of the lower sphere 101. As a result, the bottom half of the door 12 is raised slightly outwardly and the door 12 is cocked from side to side. In the position as shown in FIG. 4, the center of gravity of the door 12 is shifted further outwardly from the plane of the door frame opening 16 to cause the door 12 to fall when it is released such that it tends to assume a vertical disposition. When the door 12 is released by the person opening the door, the door 12 falls under the force of gravity, whereby the arm 96 pivots or swings about the socket 90 so that the door 12 falls under the force of gravity and swings into its closed position until the ball 98 engages the socket 88.

While the present invention has been described in connection with a particular embodiment thereof, it will be understood that many changes and modifications of this invention may be made by those skilled in the art without departing from the true spirit and scope thereof. It is to be understood that while a double swing door is shown, a single swing door may also be made in accordance with the present invention and one of the lower sockets would be eliminated. Accordingly, the appended claims are intended to cover all such changes and modifications as fall within the true spirit and scope of the present invention.

What is claimed is:

1. Closure hardware adapted to mount swingably a closure in a vertical disposition to a support frame defining a vertical opening to enable the closure to swing between an open position out of the plane of the opening and a closed position disposed within the plane of the opening, comprising:

an upper universal mounting device adapted to mount the top edge of the closure at a corner portion thereof to the frame to support swingably and universally the closure from the frame about a point disposed within the plane of the opening so that the closure disposed normally at rest in the closed position can swing out of the plane of the opening and the lower portion of the closure can tilt upwardly relative to the upper portion thereof; and a lower universal mounting device adapted to mount the side edge of the closure near the bottom edge thereof below said upper device to the adjacent portion of the frame to cause the lower portion of the closure to swing about a point outside of the plane of the opening and to cause the lower portion of the closure to tilt upwardly as the closure swings open so that when the closure is released from its open position, it falls from its open position under the force of gravity to its closed position.

2. Closure hardware according to claim 1, wherein said upper mounting device includes a first upper bracket adapted to be attached to the support frame and having an upstanding truncated sphere extending therefrom for extending in the plane of the opening, said sphere being joined to said bracket by an intermediate truncated conical portion, said upper mounting device including a second upper bracket having a depending socket adapted to be attached to said closure for swivelly and rockably receiving said truncated sphere and said conical portion.

3. Closure hardware according to claim 2, wherein said lower mounting device includes a first lower bracket adapted to be attached to the lower portion of the support frame and having at least one socket fixed thereto and disposed out of the plane of the opening on one side of the closure, an arm, a second lower bracket adapted to be attached to the lower side edge of the closure and having a sphere mounted on the distal end portion of said arm extending from said second lower bracket and swivelly attached to said socket.

4. Closure hardware according to claim 3, further including a second socket mounted on the other side of the closure extending out of the plane of the opening, a second sphere fixed to the opposite end of said arm to swivelly attach to said second socket.

5. Closure hardware according to claim 4, wherein each one of said spheres includes diametrically opposed flats.

6. Closure hardware according to claim 5, wherein each one of said sockets includes a C-shaped band of metal.

* * * * *